US007686482B2

(12) United States Patent
Gendriesch et al.

(10) Patent No.: US 7,686,482 B2
(45) Date of Patent: Mar. 30, 2010

(54) LAMP WITH SAIL-LIKE OVERHEAD ELEMENT, PREFERABLY FOR IMPROVING ACOUSTICS, ROOM FORMATION, AND INDIRECT LIGHTING OF WORKPLACES

(75) Inventors: Jürgen Gendriesch, Düsseldorf (DE); Jürgen Schubert, Düsseldorf (DE); Alexander Prang, Düsseldorf (DE)

(73) Assignee: Ructurelab GmbH, Dusseldorf (DE)

( * ) Notice: Subject to any disclaimer, the term of this patent is extended or adjusted under 35 U.S.C. 154(b) by 0 days.

(21) Appl. No.: 12/106,503

(22) Filed: Apr. 21, 2008

(65) Prior Publication Data

US 2008/0278933 A1 Nov. 13, 2008

(30) Foreign Application Priority Data

May 11, 2007 (DE) ..... 20 2007 006 799 U

(51) Int. Cl.
*F21V 1/00* (2006.01)

(52) U.S. Cl. ..... 362/350; 362/16; 362/18; 362/361; 362/127

(58) Field of Classification Search ..... 362/8, 362/16, 18, 253, 269, 350, 355, 358, 361, 362/127
See application file for complete search history.

(56) References Cited

U.S. PATENT DOCUMENTS

| | | | | |
|---|---|---|---|---|
| 375,953 A | | 1/1888 | Richter | |
| 4,078,170 A | * | 3/1978 | Sloop | 362/322 |
| 4,524,405 A | * | 6/1985 | Heard | 362/18 |
| 4,991,065 A | | 2/1991 | Engel | 362/33 |
| 6,227,687 B1 | * | 5/2001 | Kahwaji | 362/391 |
| 6,234,638 B1 | * | 5/2001 | Beverly | 362/16 |

FOREIGN PATENT DOCUMENTS

| | | |
|---|---|---|
| CH | 322095 | 5/1957 |
| DE | 3121802 | 12/1982 |
| DE | 8407094 | 7/1984 |
| DE | 3416161 | 11/1985 |
| DE | 8629602 | 12/1986 |
| DE | 29503164 | 5/1995 |
| DE | 20319962 | 6/2005 |
| DE | 102004063154 | 7/2006 |
| WO | WO 0120225 | 3/2001 |

* cited by examiner

*Primary Examiner*—Laura Tso
(74) *Attorney, Agent, or Firm*—Andrew Wilford

(57) ABSTRACT

A light fixture shining light upward has a mast with a base or is attached to room or furniture systems. In order to improve the acoustics or a room, structure of a room, and/or for the indirect lighting of workplaces, a canopy element including a textile canopy and a frame stretching the textile canopy has at least one shaft-like element of the frame located eccentrically relative to the canopy, and is attached to the light-fixture mast or another part of the light fixture shining light upward.

11 Claims, 15 Drawing Sheets

LAMP WITH SAIL-LIKE OVERHEAD ELEMENT, PREFERABLY FOR IMPROVING ACOUSTICS, ROOM FORMATION, AND INDIRECT LIGHTING OF WORKPLACES

FIELD OF THE INVENTION

The present invention relates to a light fixture.

PRIOR ART

A light fixture is known that shines light upward (and downward) and that has a mast for the indirect (and direct) lighting of workplaces. The upwardly directed light from these light fixtures is reflected by the ceiling and generates indirect light on the workplace. These light fixtures have the disadvantage that the upwardly directed light is not reflected in high-ceilinged rooms, that the light fixtures do not improve the acoustics of the room, and that the light fixtures contribute only very little or not at all to the structure of the room.

Moreover, light fixtures are known that direct light upward having a mast and non-textile reflectors. However, due to the small reflectors required by their construction, the quality of the indirect light from light fixtures of this type is not comparable with light reflected over large surfaces via a white ceiling. These light fixtures also do not improve the acoustics of a room.

Furthermore, light fixtures are known having a mast and a textile shade. Here, the shade has the function of screening off direct light. Shades of this type are open at the top and do not reflect light shining upward.

Moreover, acoustical shades are known, normally in the form of so-called funnel shades with a central mast that is preferably placed on the floor on a stand, as are acoustical sails freely spanning a room, as well as light and acoustical elements that may be hung from the ceiling or on the wall, etc. Such systems may be used for the reflection of upwardly directed light from a light fixture, but they have the disadvantage of being unable to react to different workplace situations and configurations of tables and/or workplaces.

OBJECT OF THE INVENTION

The object of the invention is to develop a light fixture that improves room acoustics, room structure, and indirect lighting of workplaces even in high-ceilinged rooms, and by means of which it is possible to react to different workplace situations and configurations of tables and/or workplaces.

SUMMARY OF THE INVENTION

This object is attained in that, in order to improve the acoustics or a room, structure of a room, and/or for the indirect lighting of workplaces, a canopy element, including a textile canopy and a frame stretching the textile canopy and having at least one shaft-like element of the frame located eccentrically relative to the canopy, is attached on the light fixture mast or another part of the light fixture shining light upward.

The light fixture with the above-given features solves and/or improves workplace situations in many respects: the optical reflection properties of the textile canopy of the ceiling element create an indirect illumination portion. The acoustic properties, in particular the acoustic absorption properties of the textile canopy of the ceiling element improve, in particular, reduce, the reverberation period. The canopy element has a space-structuring effect in that it partially or completely covers workplace configurations.

The light fixture with the described features is able to react in a simple and individual fashion to changing workplace configurations. By virtue of the minimal weight of the sail-like canopy as well as the eccentric position of the shaft element, it may be favorably set up in the space in a flexible and modular fashion or attached to furniture systems and equipped with one or more adjustable-height and rotatable canopy elements. In this context, "eccentric" means that the shaft-like element, as long as it has a vertical orientation, is located outside the area of the canopy with regard to its footprint.

The light fixture with the described features may be able to make a significant contribution to a reduction in construction and operating costs: acoustic measures such as acoustical ceilings may be entirely or partially omitted. Wiring in the ceiling, especially for suspended light fixtures, may be partially or completely omitted. Electricity use may be reduced by the targeted illumination of local workplace configurations. In the case of changes to the structure or the room, the light fixtures may be easily moved. Furniture measures for the division and/or marking of workplace configurations may be partially or completely omitted.

BRIEF DESCRIPTION OF THE DRAWINGS

Embodiments will be described with reference to FIGS. 1 to 8.

SPECIFIC DESCRIPTION

Figure 1A:
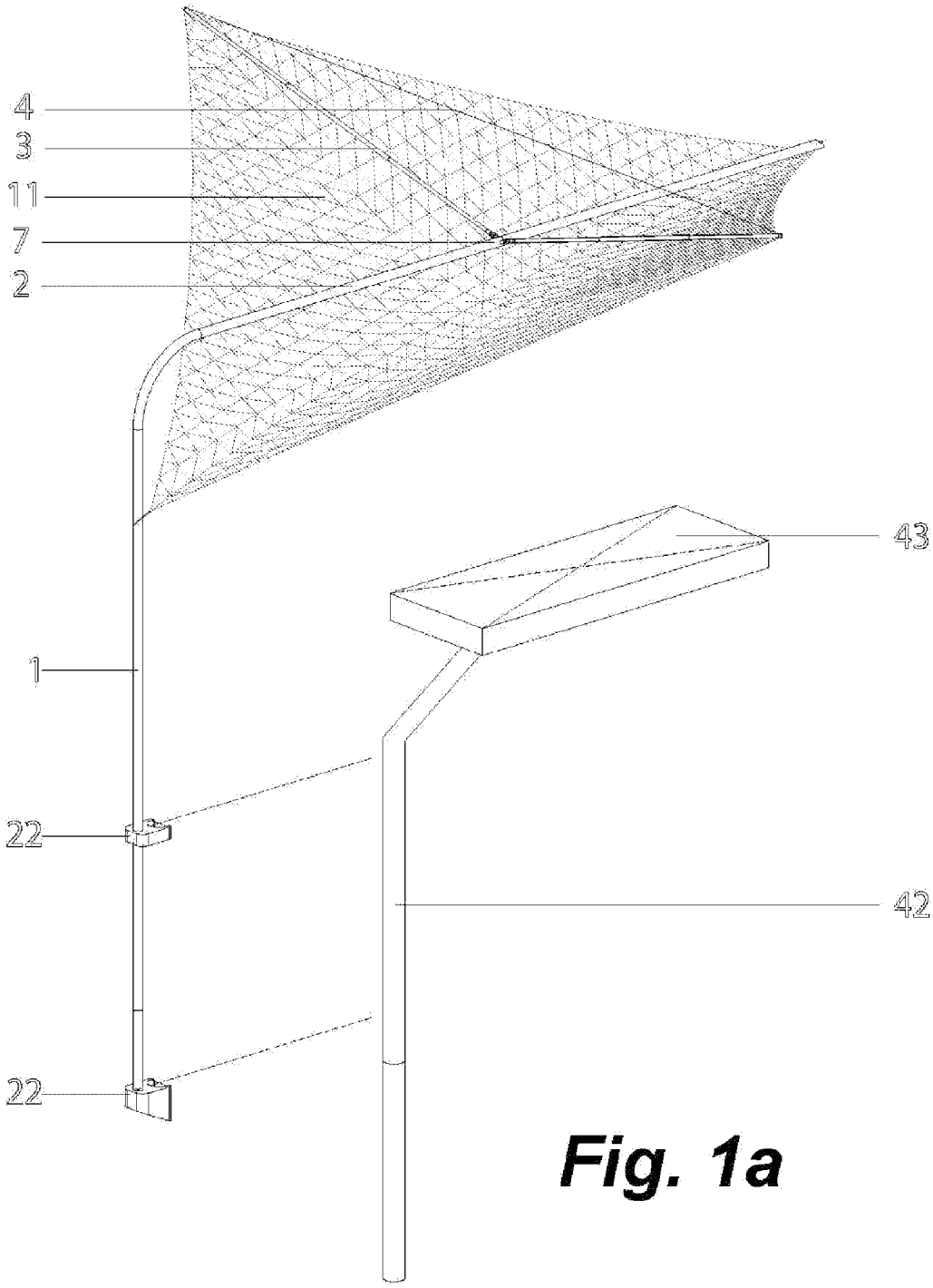
FIG. 1 shows the light fixture of the instant invention.
Figure 1B:
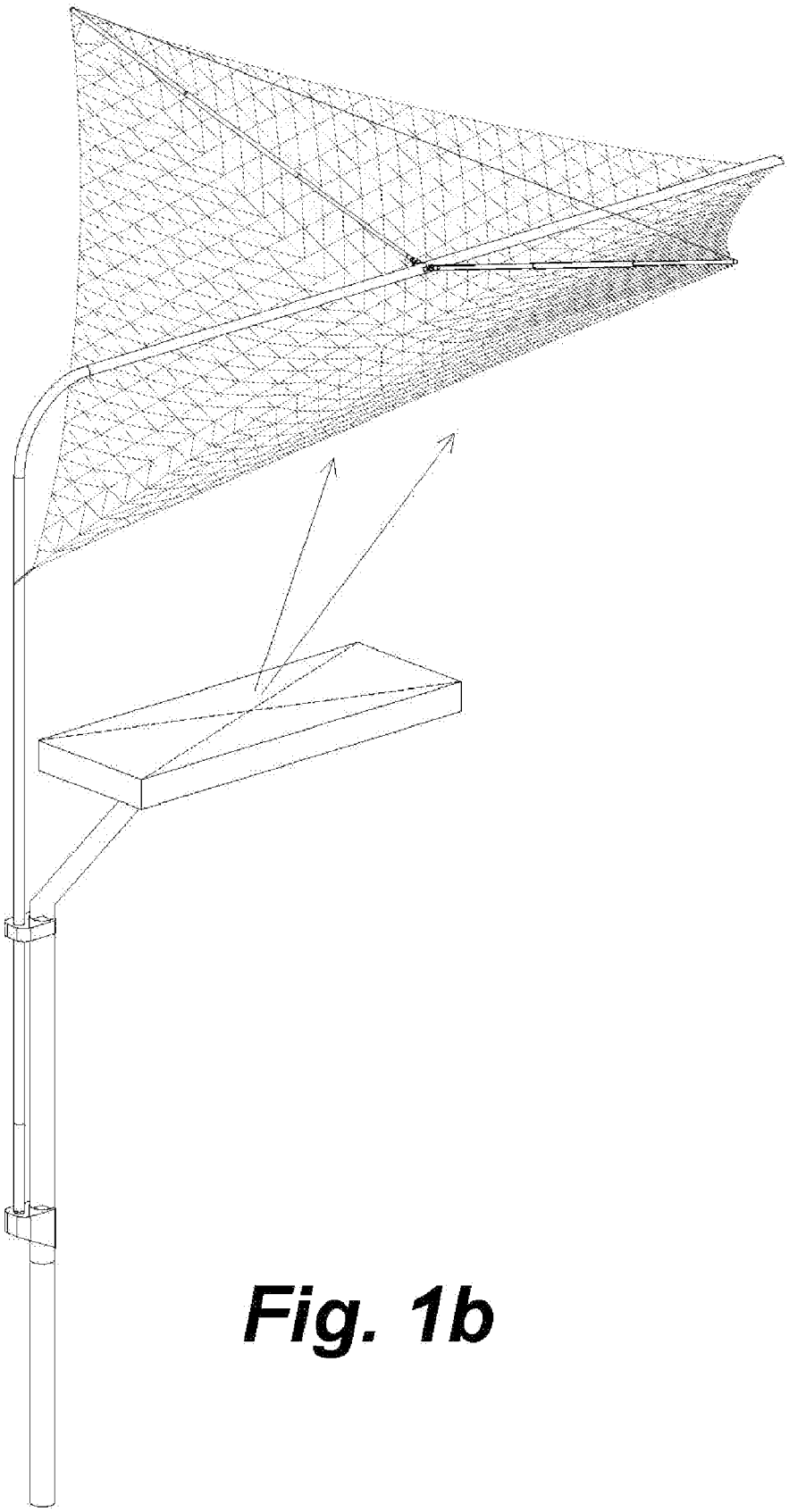

FIGS. 1*a-b* show a light fixture 43 projecting light upward and having a light fixture mast 42 to which a canopy module including a textile canopy 11 and a frame stretching the canopy 11 is secured by two clamping or connector elements 22. Instead of two, one or more clamping or connector elements 22 may also be used. The frame of the modular canopy module includes a shaft-like element 1 located eccentrically relative to the textile canopy 11 that it, after a bend on the upper end, transitions into a truss element 2. On this truss element 2, a central pivot point 7 is located to which arms 3 stretching the canopy 11 are linked. The outer ends of the arms 3 are connected via a tie element/pull rope 4, so that the canopy 11 may also be stretched particularly well. In this case, the canopy 11 is stretched between the ends of the arms 3, the shaft-like element 1, and the end of the truss element 2 and is characterized by an inversely bowed, three-dimensional shape.

Figure 2A:
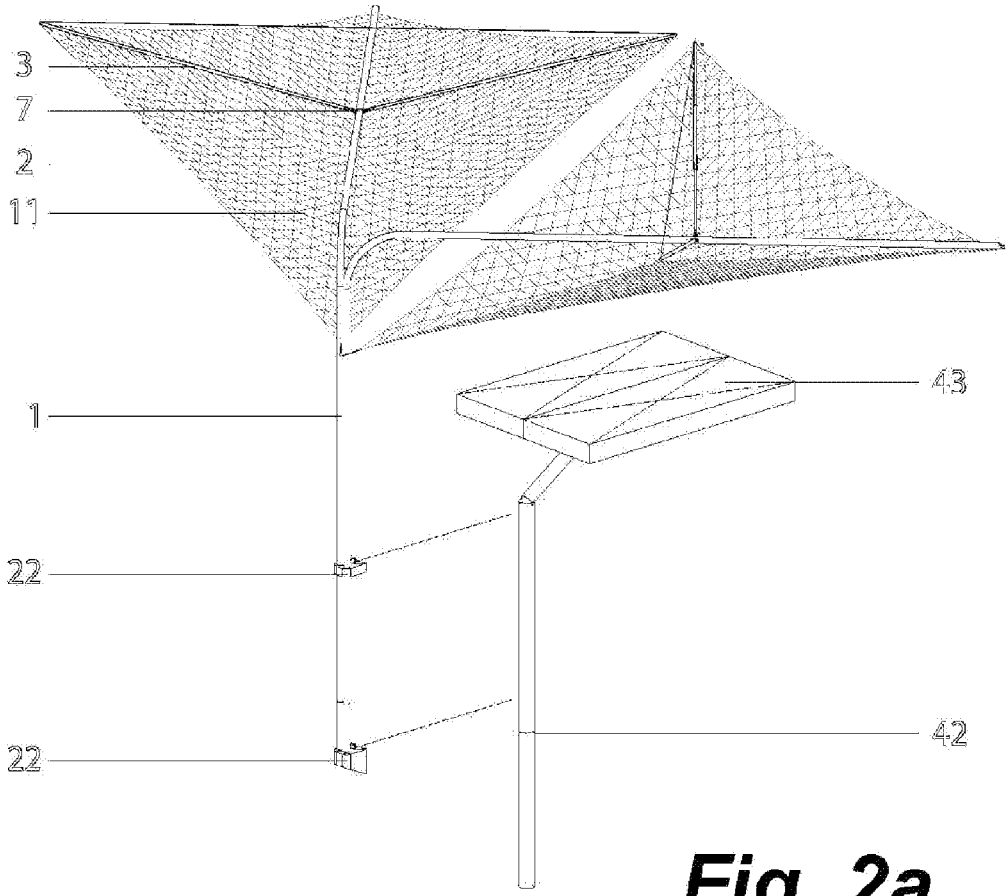
FIGS. 2 to 8 show additional embodiments and other examples.
Figure 2B:
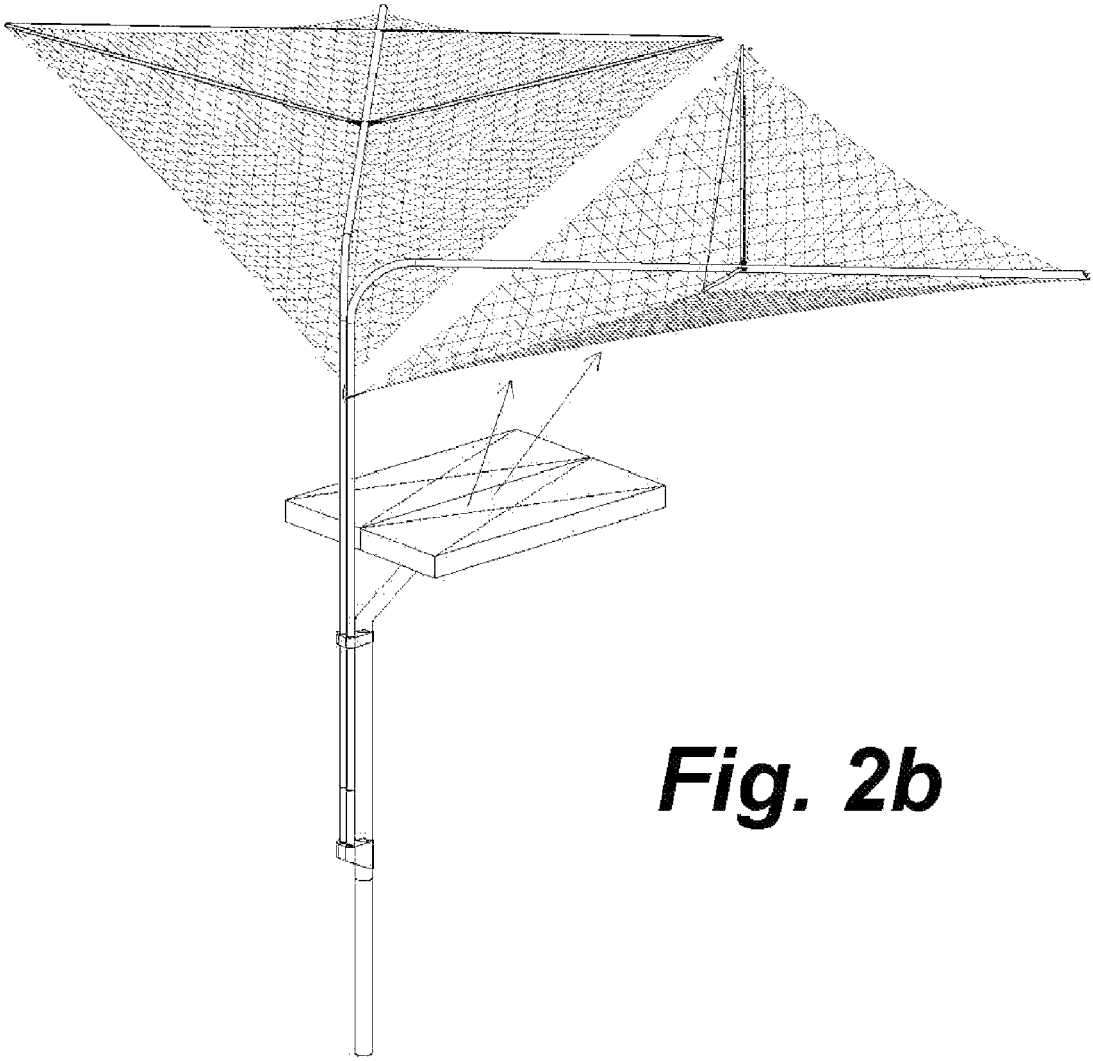

FIGS. 2*a-b* show how two canopy modules are attached to the light fixture mast 42 via two clamping or connector elements 22.

Figure 3:
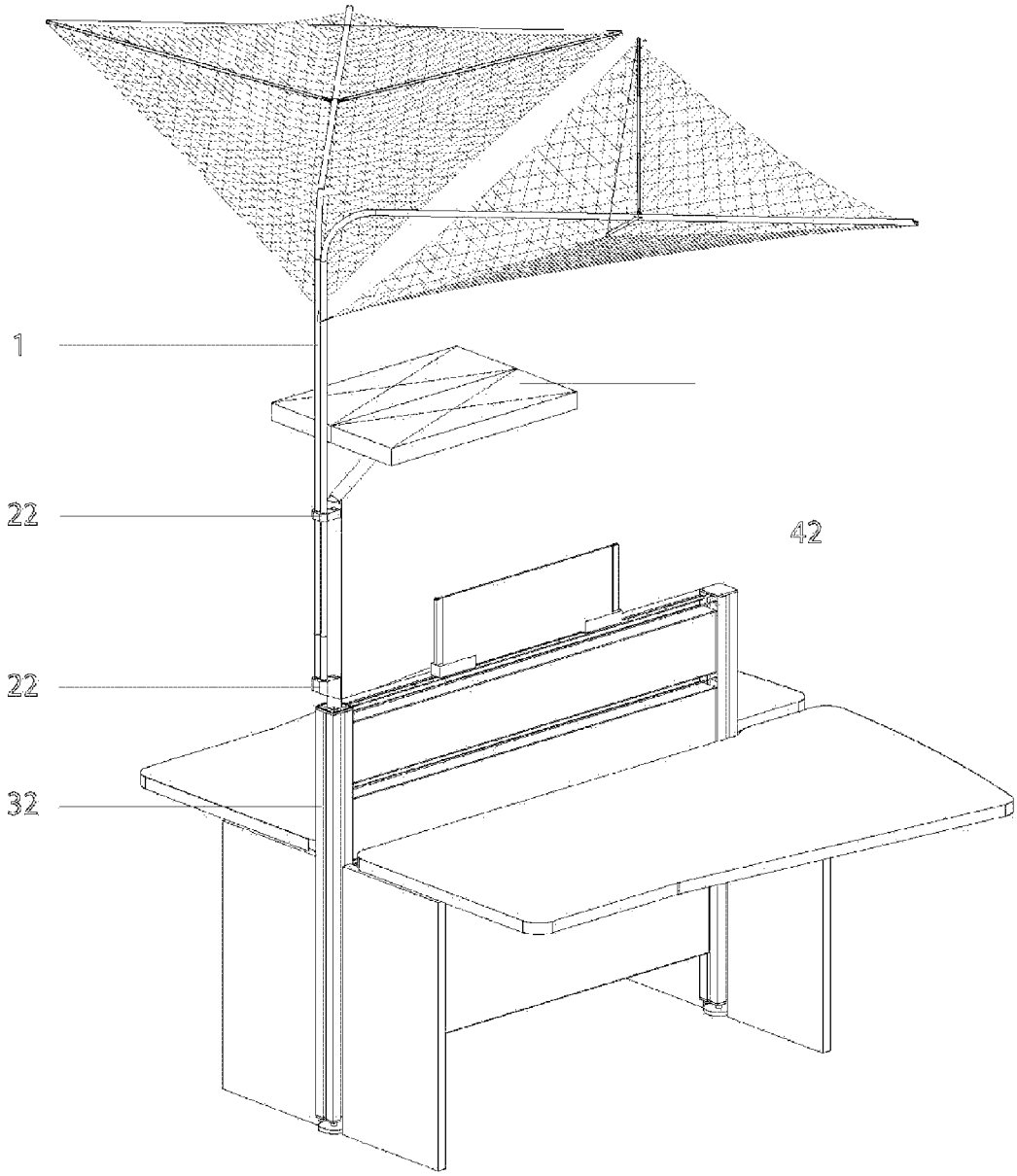
Figure 4A:
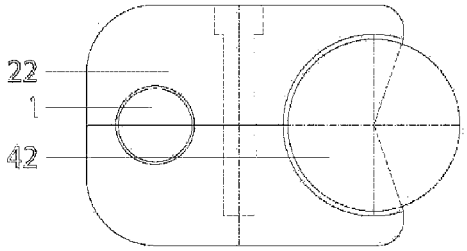
Figure 4D:
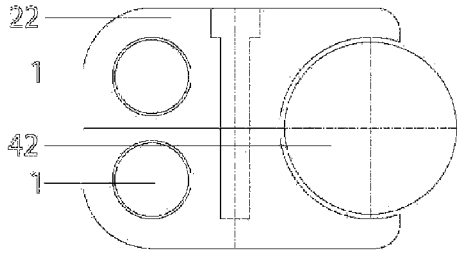
Figure 4B:
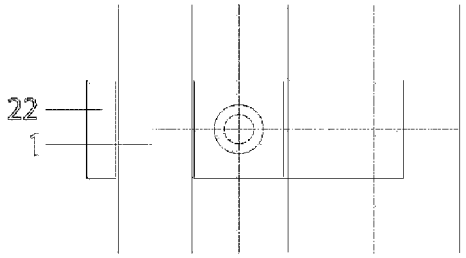
Figure 4E:
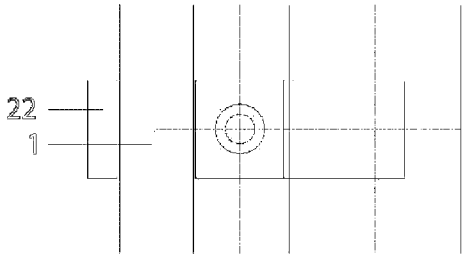
Figure 4C:
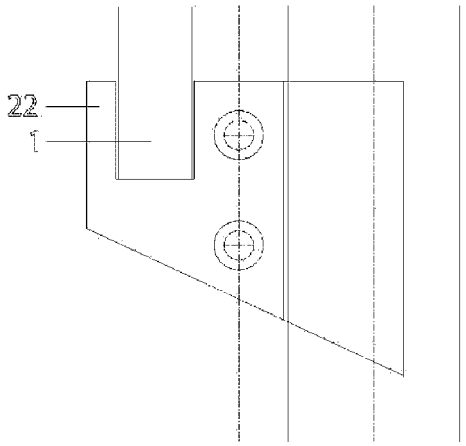
Figure 4F:
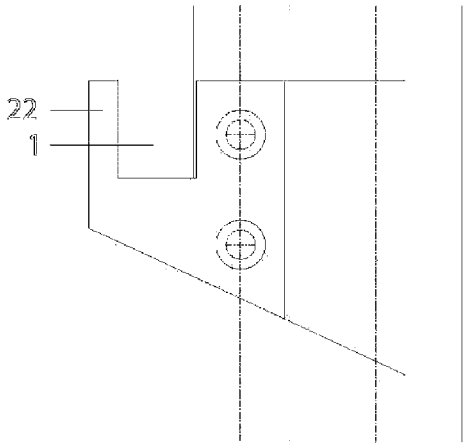

FIG. 3 shows a light fixture with canopy elements whose light fixture mast 42 is attached to room or furniture systems 32.

FIGS. 4*a-f* show possible embodiments of clamping or connector elements 22 for fastening one or two shaft-like elements 1 of canopy elements to the light fixture mast 42. The clamping or connector elements 22 may be attached to the light fixture mast 42 at any desired height and in any desired direction; in other words, they are mountable such that they may be ideally rotated and adjusted in height.

Figure 5:
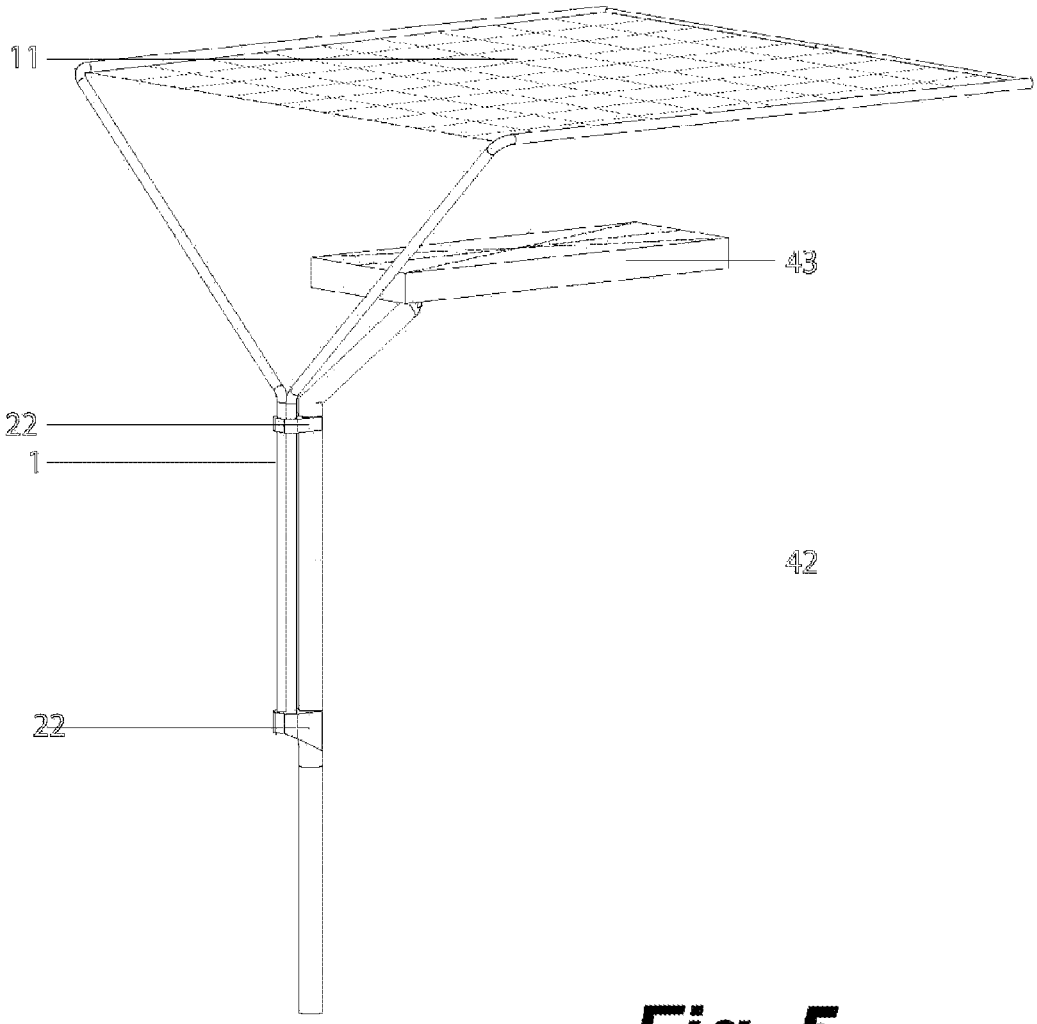
Figure 6A:
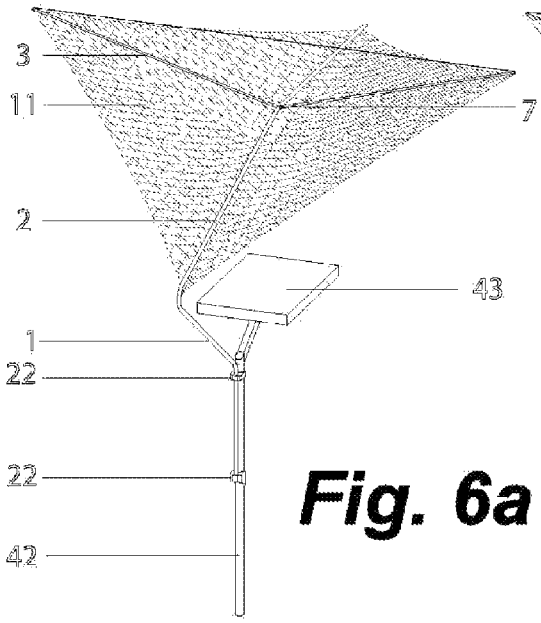
Figure 6B:
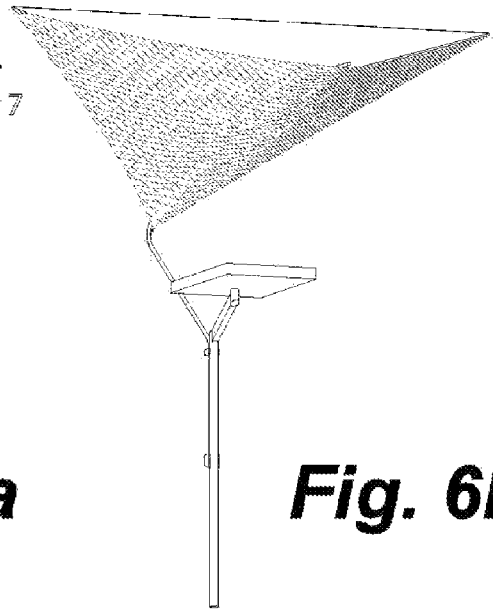
Figure 6C:
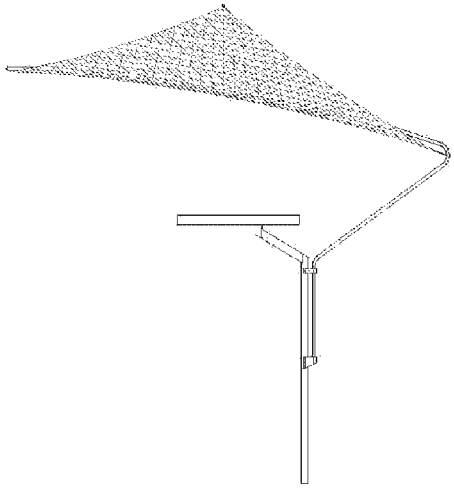
Figure 6D:
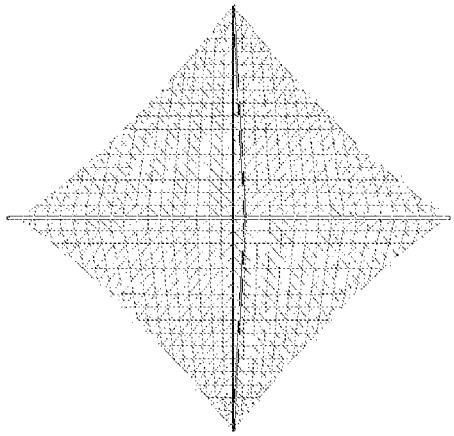
Figure 7A:
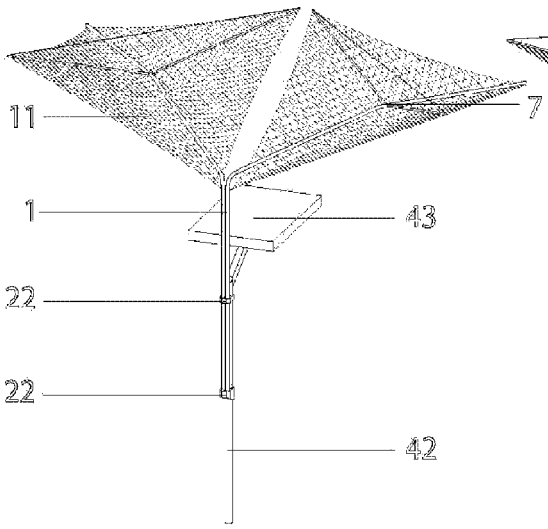
Figure 7B:
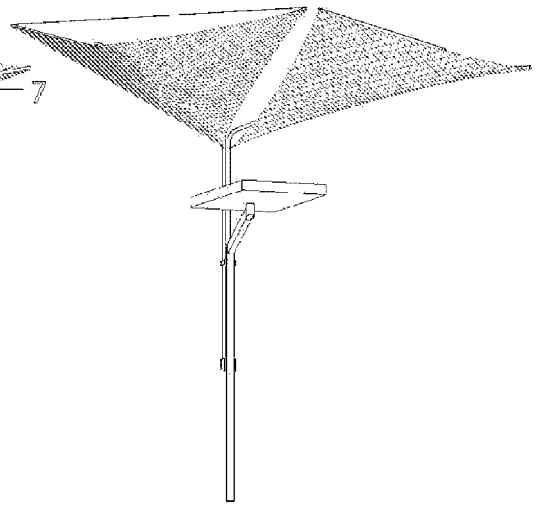
Figure 7C:
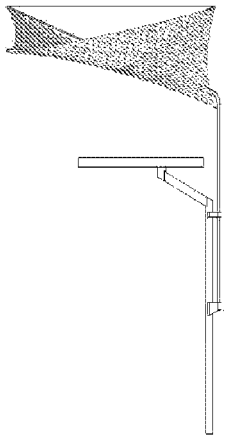
Figure 7D:
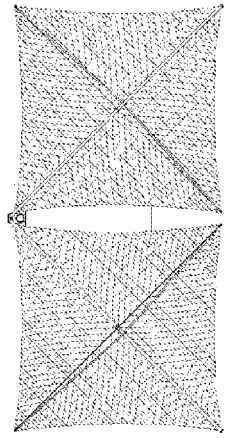

FIG. 5 shows a possible construction of the shaft-like element 1 out of multiple sections. In this variant embodiment, the canopy 11 is stretched by a frame-like structure.

FIGS. 6*a-d* show additional variants of the canopy element of the light fixture in which the canopy element is arranged centrally above the lighting head 43. The shaft-like element 1 runs from its attachment to the light fixture mast 42 initially outward and then transitions with an arc into the truss element 2. The truss element 2 follows the course of the inversely bowed textile canopy 11 in that it has a bend at the central pivot point 7, the attachment point for the arms 3.

FIGS. 7*a-d* show additional embodiments of the canopy element of the light fixture. From its attachment to the light fixture mast 42, the shaft-like element 1 runs vertically upward and then transitions with an arc into the truss element 2. The truss element 2 follows the course of the inversely bowed textile canopy 11 in that it has a bend at the central pivot point 7, the attachment point for the arms 3.

Figure 8A:
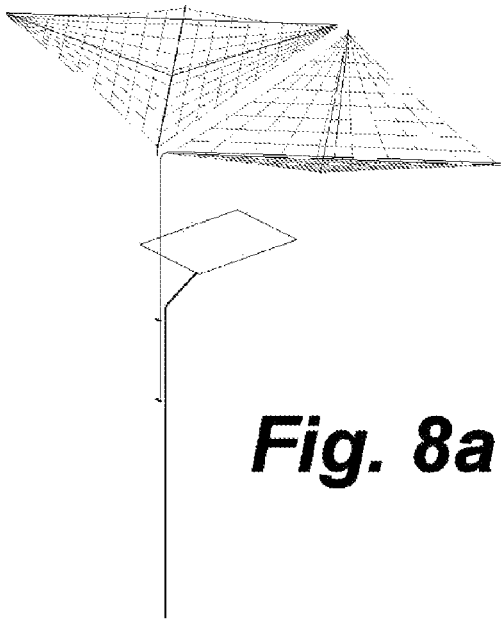
Figure 8B:
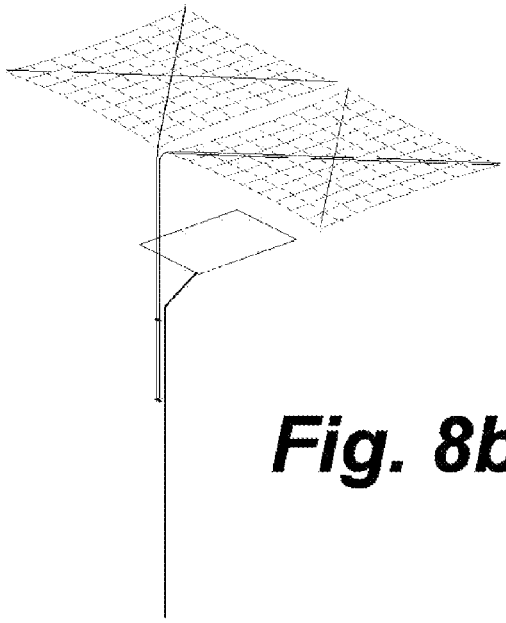
Figure 8C:
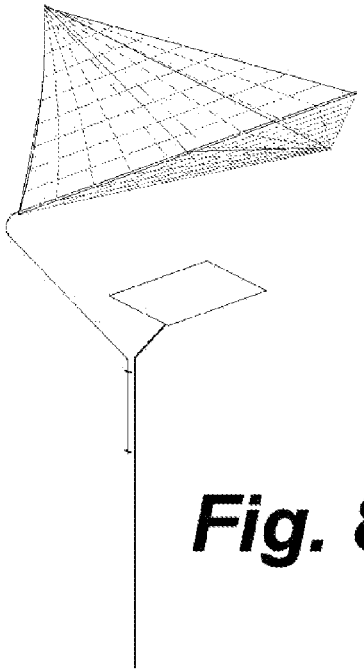
Figure 8D:
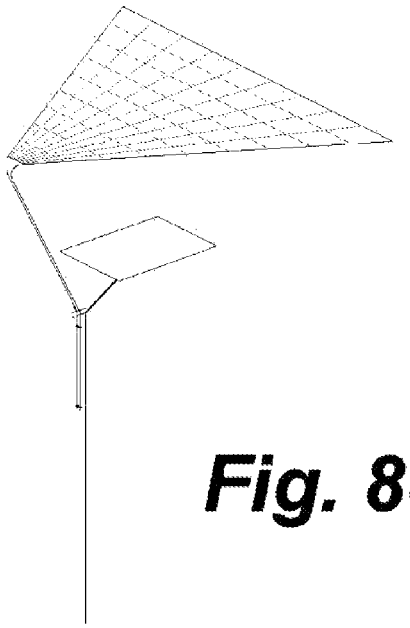
Figure 8E:
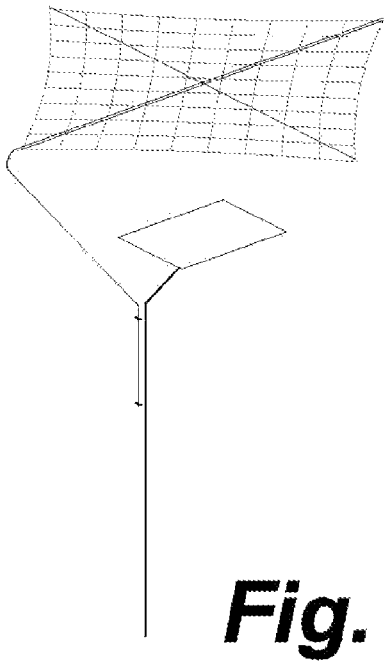
Figure 8F:
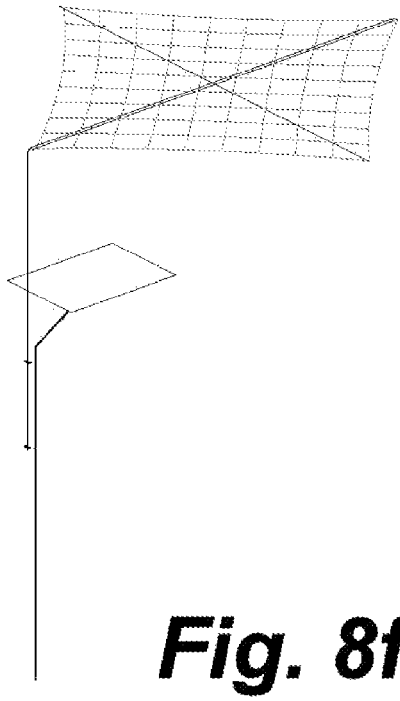
Figure 8G:
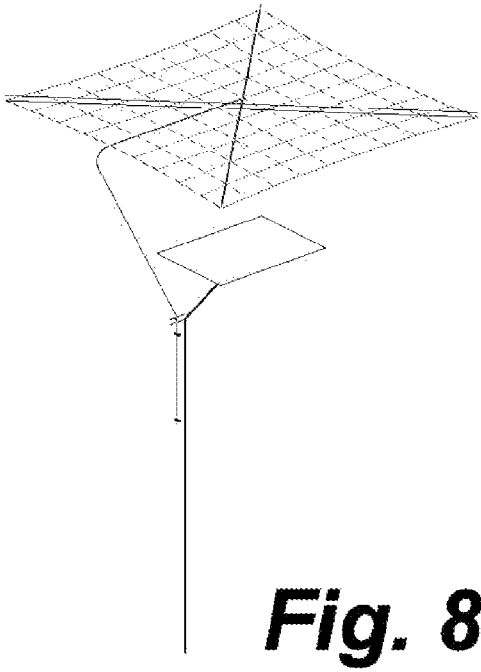
Figure 8H:
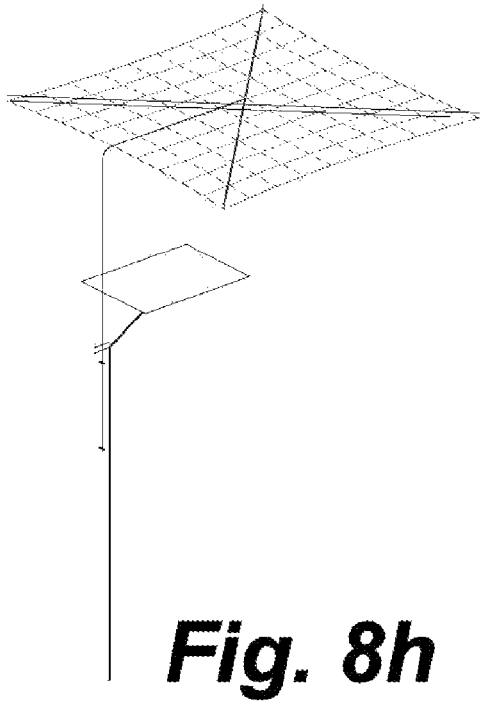
Figure 8I:
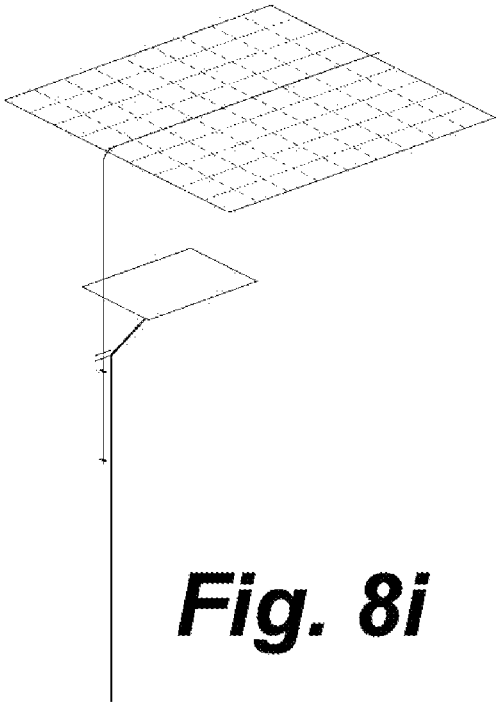
Figure 8J:
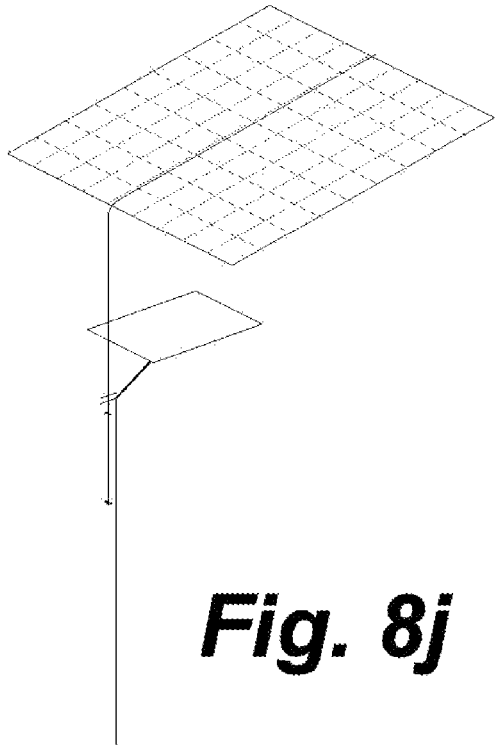
Figure 8K:
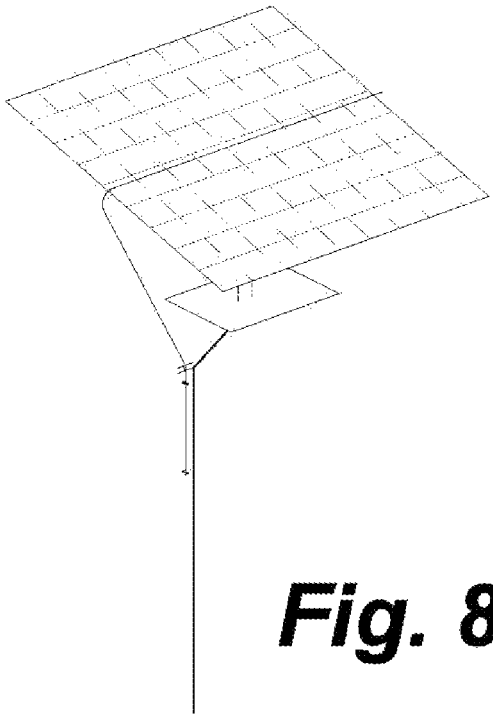
Figure 8L:
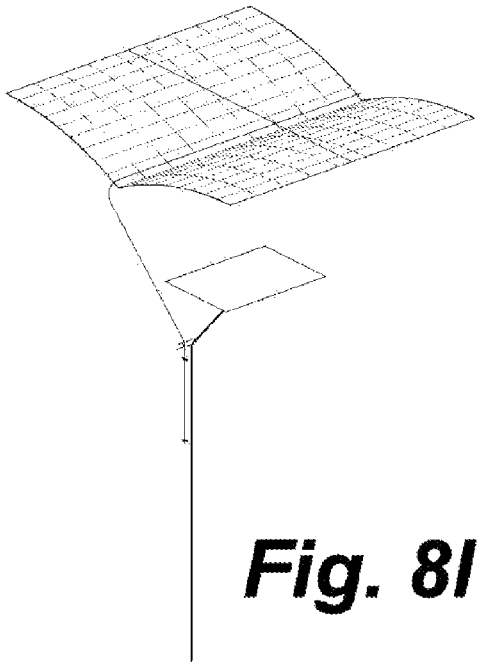
Figure 8M:
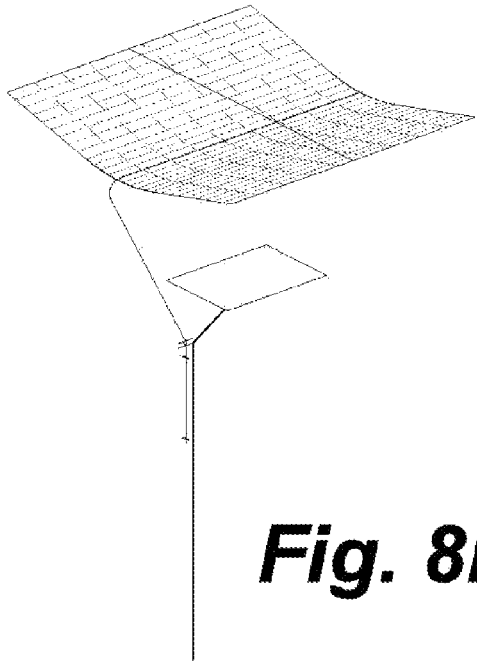
Figure 8N:
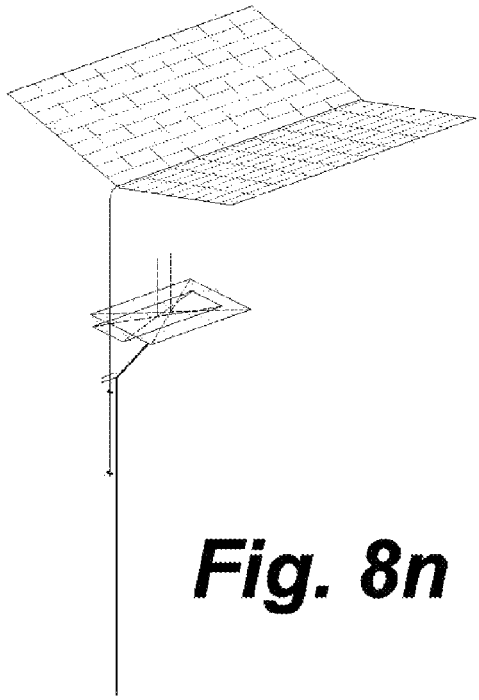
Figure 8O:
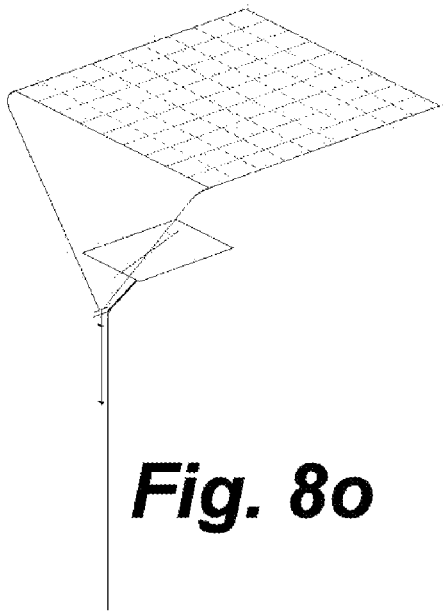
Figure 8P:
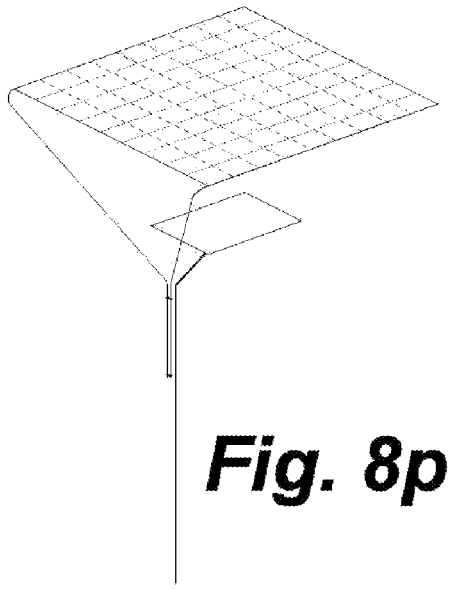
Figure 8Q:
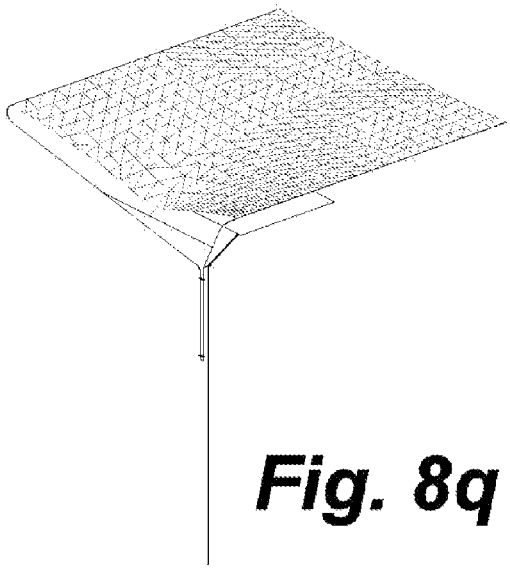
Figure 8R:
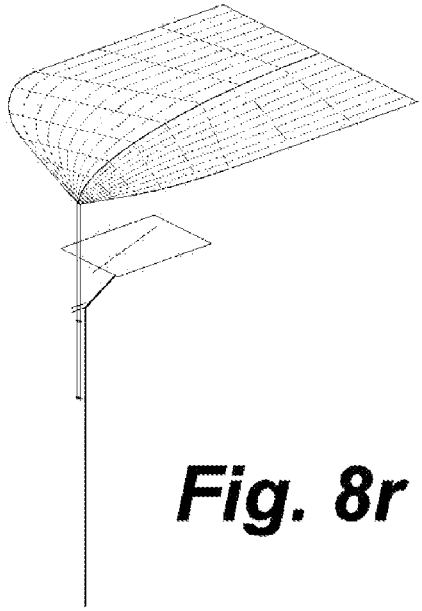
Figure 8S:
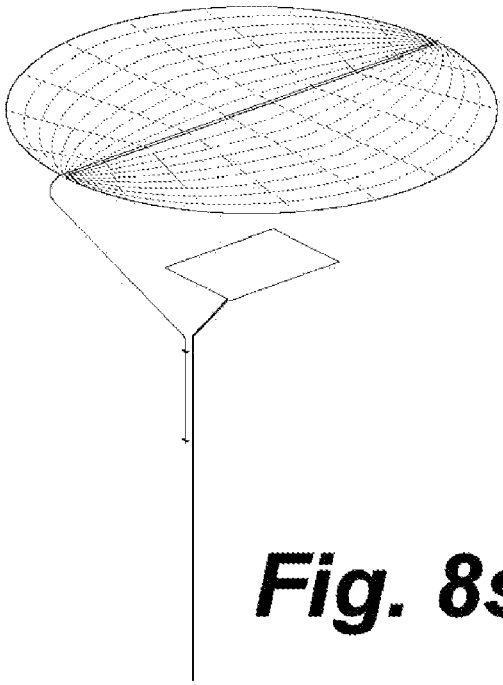
Figure 8T:
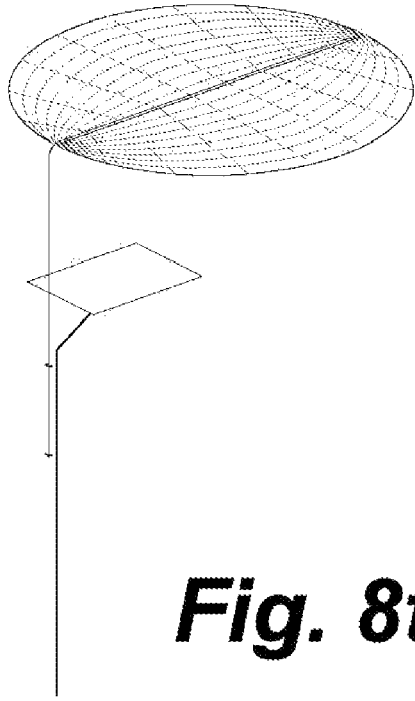
Figure 8U:
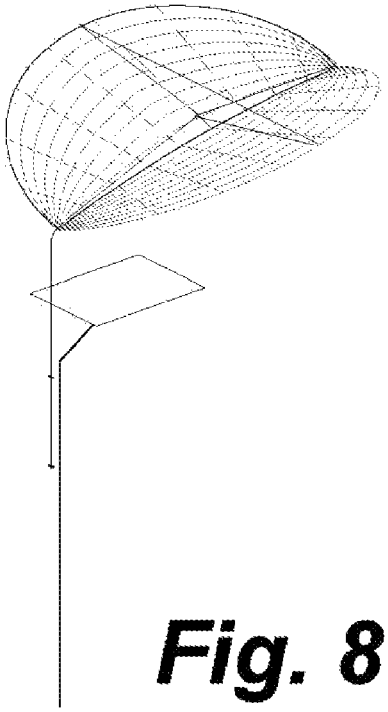
Figure 8V:
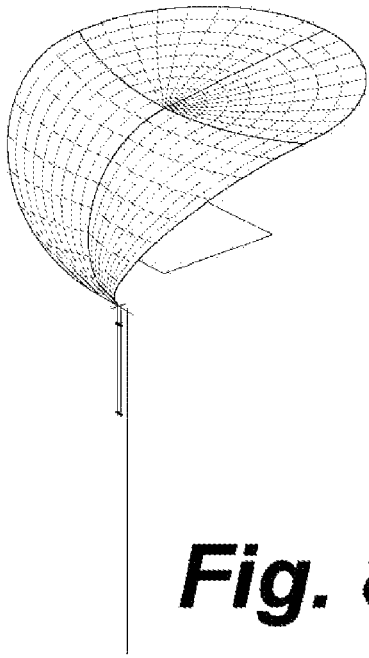

FIGS. 8*a-v* show additional embodiments of the canopy element of the light fixture.

The invention claimed is:

1. In combination with a light fixture having a vertical mast and a light-emitting unit attached to the mast and projecting light upward, a shaft;

holders secured to the shaft and to the mast and holding the shaft in a vertical position adjacent the mast, the holders being rotatable about and vertically shiftable along the mast;

a truss extending generally horizontally from an upper end of the shaft;

a frame suspended from the truss offset from the shaft and mast; and a sound-absorbing textile canopy stretched over the frame and reflecting light from the unit back downward, the shaft being horizontally offset from and not directly underneath the frame and canopy.

2. The combination according to claim 1 wherein each holder has multiple seats for the shaft such that a plurality of the canopies, shafts, and frames may be attached to the mast.

3. The combination according to claim 1 wherein the shape of the canopy extending over the light fixture is polygonal with at least three sides.

4. The combination according to claim 1 wherein the canopy extending over the light fixture forms a two-dimensional flat surface or a three-dimensional inversely bowed surface.

5. The combination according to claim 1 wherein the canopy extending over the light fixture is stretched freely at corners over the frame.

6. The combination according to claim 1 wherein the canopy extending over the light fixture has regions of different degrees of light transmission and reflection.

7. The combination according to claim 1 wherein the shaft of the canopy of the light fixture is composed of one or more slats.

8. The combination according to claim 1 wherein the canopy extending over the light fixture has a round or oval footprint.

9. The combination according to claim 1 wherein the canopy of the light fixture may be removed from the mast or from other parts of the light fixture and may be set up on a table plate with a stand/base plate via a shaft that is eccentric to the canopy.

10. The combination according to claim 1 wherein the canopy of the light fixture can be removed from the mast or from other parts of the light fixture and attached by means of a corresponding clamping element or adapter element to a table plate or to the support or connector of table plates, room systems, or furniture systems.

11. The combination defined in claim 1 wherein the shaft transitions at the upper end into the truss.

* * * * *

UNITED STATES PATENT AND TRADEMARK OFFICE

CERTIFICATE OF CORRECTION

PATENT NO. : 7,686,482 B2
APPLICATION NO. : 12/106503
DATED : March 30, 2010
INVENTOR(S) : Jürgen Gendriesch et al.

It is certified that error appears in the above-identified patent and that said Letters Patent is hereby corrected as shown below:

On the title page item (73),

The spelling of the name of the Assignee should be changed from "Ructurelab GmbH"

to -- StructureLab GMBH --

Signed and Sealed this

Twenty-fifth Day of May, 2010

David J. Kappos

David J. Kappos
*Director of the United States Patent and Trademark Office*